US009702118B2

(12) United States Patent
Gorman et al.

(10) Patent No.: US 9,702,118 B2
(45) Date of Patent: Jul. 11, 2017

(54) HYDRAULIC REGENERATIVE AND RECOVERY PARASITIC MITIGATION SYSTEM

(71) Applicant: Caterpillar Inc., Peoria, IL (US)

(72) Inventors: Corey Lee Gorman, Peoria, IL (US); John J. Krone, Peoria, IL (US); Adam Martin Nackers, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 307 days.

(21) Appl. No.: 14/547,672

(22) Filed: Nov. 19, 2014

(65) Prior Publication Data

US 2016/0138618 A1 May 19, 2016

(51) Int. Cl.
*F15B 11/024* (2006.01)
*E02F 9/22* (2006.01)
(Continued)

(52) U.S. Cl.
CPC ..... *E02F 9/2225* (2013.01); *E02F 3/32* (2013.01); *E02F 9/0866* (2013.01); *E02F 9/2285* (2013.01); *F15B 1/024* (2013.01); *F15B 21/14* (2013.01); *F15B 2211/212* (2013.01); *F15B 2211/329* (2013.01); *F15B 2211/353* (2013.01); *F15B 2211/355* (2013.01); *F15B 2211/6355* (2013.01); *F15B 2211/67* (2013.01); *F15B 2211/7058* (2013.01); *F15B 2211/7135* (2013.01); *F15B 2211/761* (2013.01)

(58) Field of Classification Search
CPC ..... E02F 3/32; E02F 9/0866; E02F 9/2225; E02F 9/2285; F15B 1/024; F15B 1/04; F15B 11/024; F15B 11/167; F15B 13/0422; F15B 13/0424; F15B 13/043; F15B 21/14; F15B 2211/212; F15B 2211/329; F15B 2211/353; F15B 2211/355; F15B 2211/575; F15B 2211/625; F15B 2211/635; F15B 2211/6355; F15B 2211/67; F15B 2211/7058; F15B 2211/7135; F15B 2211/761
See application file for complete search history.

(56) References Cited

U.S. PATENT DOCUMENTS 5,419,129 A * 5/1995 Becker ..... E02F 9/2225 60/452
6,282,890 B1 9/2001 Takano
(Continued)

FOREIGN PATENT DOCUMENTS

JP 2008 275101 11/2008
JP 2009 250361 10/2009

*Primary Examiner* — Logan Kraft
(74) *Attorney, Agent, or Firm* — James S. Bennin

(57) ABSTRACT

A hydraulic system is disclosed for use with a machine. The hydraulic system may have a pump configured to pressurize fluid, a first actuator configured to receive pressurized fluid from the pump, and an accumulator configured to receive fluid from the first actuator. The hydraulic system may also have a second actuator configured to receive pressurized fluid from the pump and the accumulator, and a pilot circuit configured to receive pressurized fluid from the pump and the accumulator. The hydraulic system may further have at least one valve movable to provide priority of fluid flow from the accumulator to the pilot circuit over the second actuator when a pressure of the accumulator is less than a low-pressure threshold.

20 Claims, 2 Drawing Sheets

(51) Int. Cl.

| | |
|---|---|
| ***F15B 21/14*** | (2006.01) |
| ***E02F 3/32*** | (2006.01) |
| ***E02F 9/08*** | (2006.01) |
| ***F15B 1/02*** | (2006.01) |

(56) References Cited

U.S. PATENT DOCUMENTS

| | | | | |
|---|---|---|---|---|
| 6,655,136 | B2 * | 12/2003 | Holt | E02F 9/2207 60/414 |
| 6,959,671 | B2 * | 11/2005 | Nakagawa | E02F 9/0866 123/41.12 |
| 7,392,653 | B2 | 7/2008 | Sugano | |
| 7,634,911 | B2 | 12/2009 | Brinkman | |
| 8,997,476 | B2 * | 4/2015 | Brinkman | F15B 21/14 60/414 |
| 9,309,899 | B2 * | 4/2016 | Kim | E02F 9/2217 |
| 2009/0094973 | A1 | 4/2009 | Cheong | |
| 2012/0031088 | A1 * | 2/2012 | Takebayashi | E02F 9/2225 60/452 |
| 2013/0098012 | A1 * | 4/2013 | Opdenbosch | F15B 1/024 60/327 |
| 2013/0098022 | A1 | 4/2013 | Kim et al. | |
| 2014/0026550 | A1 | 1/2014 | Brinkman et al. | |

* cited by examiner

HYDRAULIC REGENERATIVE AND RECOVERY PARASITIC MITIGATION SYSTEM

TECHNICAL FIELD

The present disclosure relates generally to a hydraulic system and, more particularly, to a hydraulic system having energy recovery with pilot priority.

BACKGROUND

Hydraulic machines such as dozers, loaders, excavators, backhoes, motor graders, and other types of heavy equipment use one or more hydraulic actuators to accomplish a variety of tasks. These actuators are fluidly connected to a pump of the machine that provides pressurized fluid to chambers within the actuators. As the pressurized fluid moves into or through the chambers, the pressure of the fluid acts on hydraulic surfaces of the chambers to affect movement of the actuators and a connected work tool. When the pressurized fluid is drained from the chambers it is returned to a low-pressure sump of the machine.

One problem associated with this type of hydraulic arrangement involves efficiency. In particular, the fluid draining from the actuator chambers to the sump often has a pressure greater than a pressure of the fluid already within the sump, especially when the actuators are moving in a direction aligned with the pull of gravity (i.e., when actuator movement is being assisted by a weight of the tool and associated load). As a result, the higher pressure fluid draining into the sump still contains some energy that is wasted upon entering the low-pressure sump. This wasted energy reduces the efficiency of the hydraulic system.

One attempt to improve the efficiency of a hydraulic machine is disclosed in U.S. Patent Publication No. 2014/0026550 of Brinkman et al, that published on Jan. 30, 2014 ("the '550 publication"). In particular, the '550 publication discloses a hydraulic system having a boom cylinder, and an accumulator connected to receive fluid from the boom cylinder during lowering of a boom. The hydraulic system also has a fan motor connected to the accumulator via an independent metering valve. The accumulator is configured to selectively discharge accumulated fluid to drive the fan motor, thereby recovering energy that would otherwise be lost. A charge pump is configured to provide makeup fluid to the fan motor and to a pilot supply.

Although the system of the '550 publication may help to improve efficiencies in some situations through storage and reuse of pressurized fluid, it may still be improved upon. In particular, there may be other components and/or circuits of the hydraulic system that could benefit from use of the accumulated fluid, and the '550 publication does not disclose how to share the fluid between competing components or circuits.

The disclosed hydraulic system is directed to overcoming one or more of the problems set forth above and/or other problems of the prior art.

SUMMARY

One aspect of the present disclosure is directed to a hydraulic system. The hydraulic system may include a pump configured to pressurize fluid, a first actuator configured to receive pressurized fluid from the pump, and an accumulator configured to receive fluid from the first actuator. The hydraulic system may also include a second actuator configured to receive pressurized fluid from the pump and the accumulator, and a pilot circuit configured to receive pressurized fluid from the pump and the accumulator. The hydraulic system may further include at least one valve movable to provide priority of fluid flow from the accumulator to the pilot circuit over the second actuator when a pressure of the accumulator is less than a low-pressure threshold.

Another aspect of the present disclosure is directed to a machine. The machine may include a frame, a boom pivotally connected to the frame, a boom cylinder configured to move the boom, and an engine supported by the frame. The machine may further include a fan configured to cool the engine, a fan motor configured to drive the fan, and a pump driven by the engine to pressurize fluid directed to the boom cylinder and to the fan motor. The machine may also include a boom control valve disposed between the pump and the boom cylinder and movable to affect fluid flow from the pump into the boom cylinder, an operator input device movable to indicate a desire to raise or lower the boom, and a pilot valve connected to the operator input device and movable to affect a flow of pilot fluid to the boom control valve. The machine may additionally include a pressure control valve movable to affect a flow of pilot fluid to the boom control valve, a shuttle valve disposed between the boom control valve and the pilot and pressure control valves, and an accumulator configured to receive fluid discharged from the boom cylinder, and to discharge fluid to the fan motor and to the pilot and pressure control valves. The machine may also include a priority valve configured to selectively block fluid flow from the accumulator to the fan motor when a pressure of the accumulator is less than a low-pressure threshold.

Another aspect of the present disclosure is directed to a method of recovering energy. The method may include pressurizing fluid at a first location, directing pressurized fluid from the first location through a control valve to a first actuator and to a second actuator, and accumulating fluid discharged from the first actuator. The method may also include directing accumulated fluid to the second actuator and to a pilot circuit associated with the first actuator, and selectively inhibiting accumulated fluid from flowing to the second actuator based on a pressure of the accumulated fluid.

DETAILED DESCRIPTION

Figure 1:
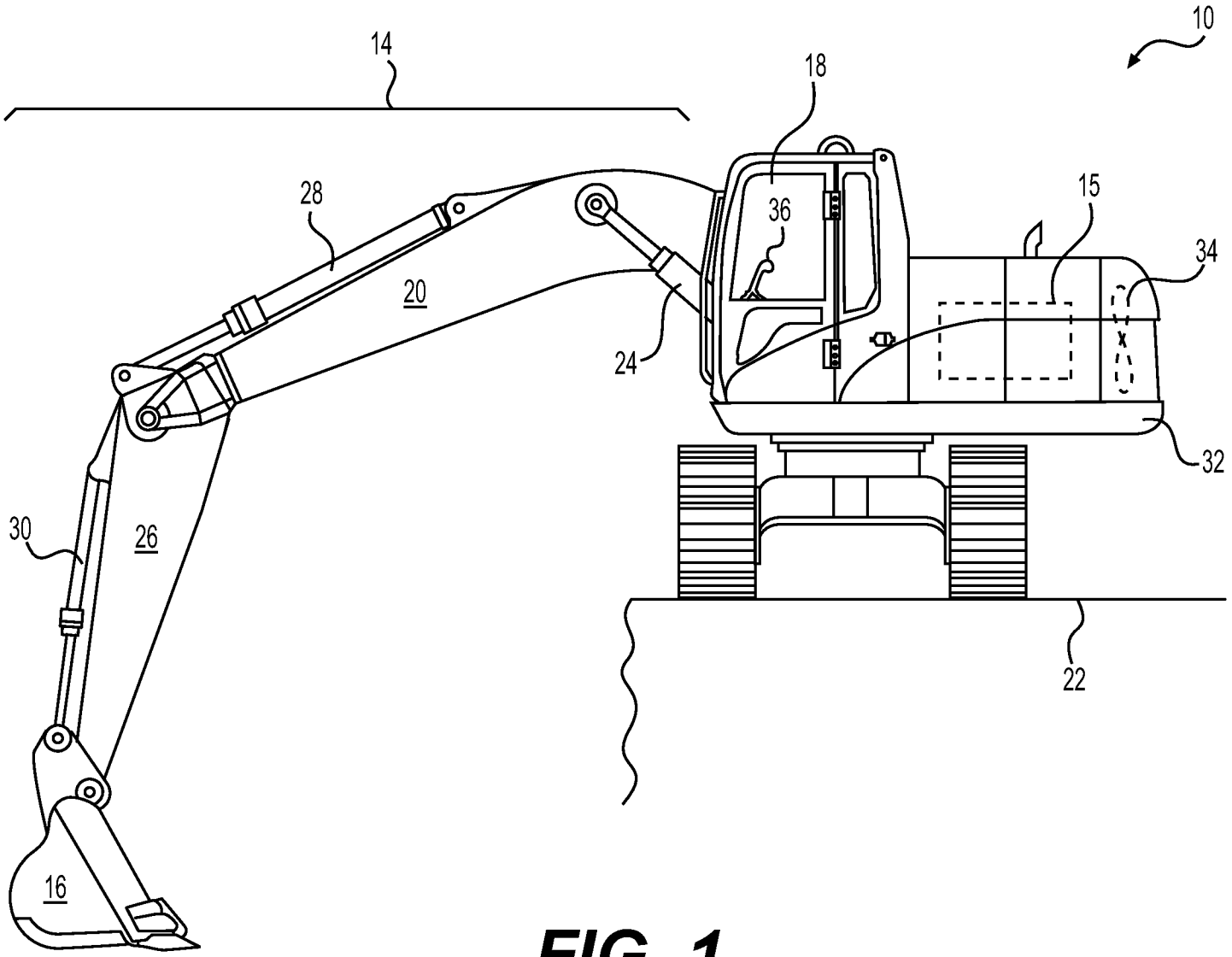
FIG. 1 is an isometric illustration of an exemplary disclosed machine.

FIG. 1 illustrates an exemplary machine 10 having multiple systems and components that cooperate to move material such as ore, overburden, waste, etc. In the depicted example, machine 10 is a hydraulic excavator. It is contemplated, however, that machine 10 could alternatively embody another excavation or material handling machine, such as a backhoe, a front shovel, a dragline excavator, a crane, or another similar machine. Machine 10 may include, among other things, a linkage arrangement 14 configured to move a work tool 16, an operator station 18 for manual control of linkage arrangement 14, and a power source 15 (e.g., an engine) that provides electrical, hydraulic, and/or mechanical power to linkage arrangement 14 and operator station 18. It is contemplated that machine 10 may perform any operation known in the art, for example truck loading, craning, trenching, and material handling.

Linkage arrangement 14 may include fluid actuators that exert forces on structural components to move work tool 16. Specifically, linkage arrangement 14 may include a boom 20 that is vertically pivotal relative to a work surface 22 by a pair of adjacent, double-acting, hydraulic cylinders 24 ("boom cylinders"—only one shown in FIG. 1). Linkage arrangement 14 may also include a stick 26 that is vertically pivotal relative to boom 20 by a single, double-acting, hydraulic cylinder 28 ("stick cylinder"). Linkage arrangement 14 may further include a single, double-acting, hydraulic cylinder 30 ("tool cylinder") that is operatively connected to work tool 16 to tilt work tool 16 vertically relative to stick 26. Boom 20 may be pivotally connected to a frame 32 of machine 10. It is contemplated that a greater or lesser number of fluid actuators may be included within linkage arrangement 14, and connected in a manner other than described above, if desired.

Power source 15 may be supported by frame 32 of machine 10, and configured to combust a mixture of fuel and air to generate the electrical, hydraulic, and/or mechanical power discussed above. During this combustion process and also during movement of work tool 16 by linkage arrangement 14, heat may be generated as a byproduct. In order to ensure continued operation of machine 10, this heat should be dissipated to the atmosphere. For this purpose, a fan 34 may be associated with power source 15 and/or linkage arrangement 14, and configured to chill air, coolant, engine oil, and/or hydraulic fluid directed throughout machine 10.

Numerous different work tools 16 may be attachable to a single machine 10 and controllable via operator station 18. Work tool 16 may include any device used to perform a particular task such as, for example, a bucket, a fork arrangement, a blade, a shovel, a crusher, a shear, a grapple, a grapple bucket, a magnet, or any other task-performing device known in the art. Although connected in the embodiment of FIG. 1 to lift, swing, and tilt relative to machine 10, work tool 16 may alternatively or additionally rotate, slide, extend, open and close, or move in another manner known in the art.

Operator station 18 may be configured to receive input from a machine operator indicative of a desired work tool movement. Specifically, operator station 18 may include one or more input devices 36 embodied, for example, as single or multi-axis joysticks located proximal an operator seat (not shown), input devices 36 may be proportional-type controllers configured to position and/or orient work tool 16 by producing a work tool position signal that is indicative of a desired work tool speed and/or force in a particular direction. The position signal may be used to actuate any one or more of hydraulic cylinders 24, 28, 30. It is contemplated that different input devices may additionally or alternatively be included within operator station 18 such as, for example, wheels, knobs, push-pull devices, switches, pedals, and other operator input devices known in the art.

Figure 2:
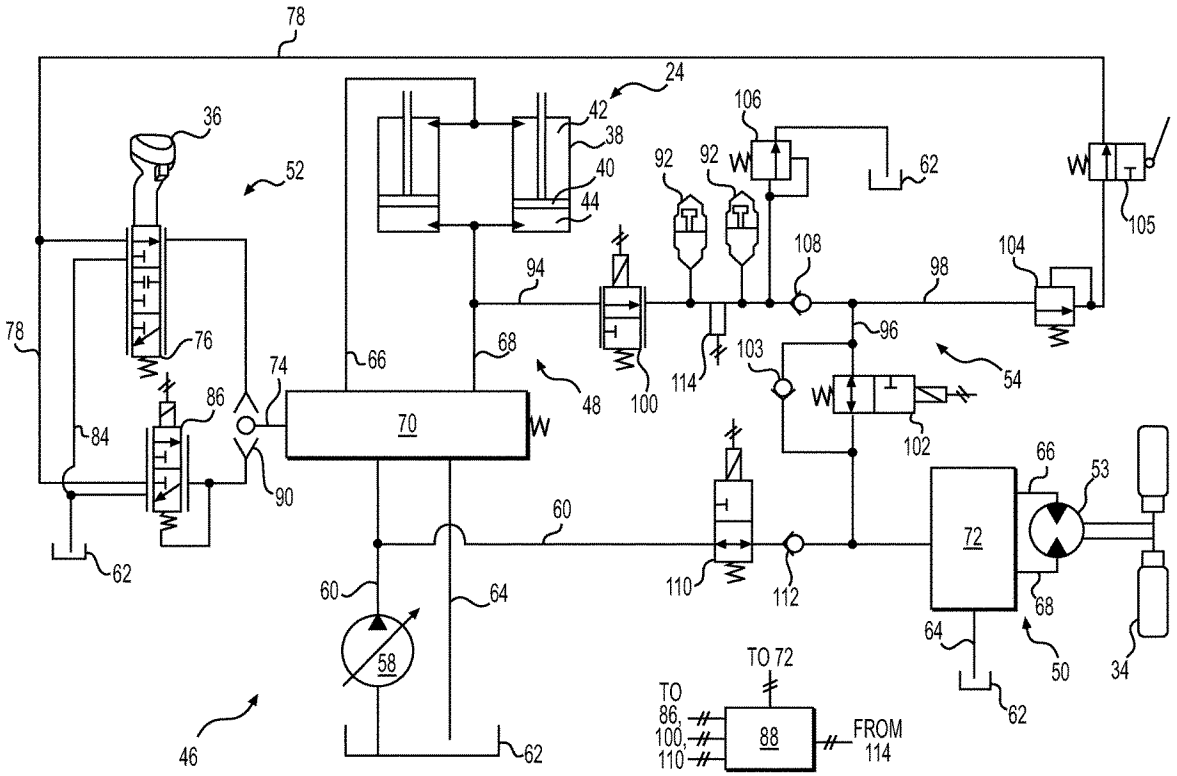
FIG. 2 is a schematic illustration of an exemplary disclosed hydraulic system that may be used in conjunction with the machine of FIG. 1.

As shown in FIG. 2, boom cylinders 24 (as well as stick and tool cylinders 28, 30—shown only in FIG. 1) may each include a tube 38 and a piston assembly 40 arranged within tube 38 to form a first chamber 42 and an opposing second chamber 44. In one example, a rod portion of piston assembly 40 may extend through an end of first chamber 42. As such, first chamber 42 may be considered the rod-end chamber of boom cylinders 24, while second chamber 44 may be considered the head-end chamber. Chambers 42, 44 may each be selectively supplied with pressurized fluid and drained of the pressurized fluid to cause piston assembly 40 to displace within tube 38, thereby changing an effective length of boom cylinders 24 and moving work tool 16 (referring to FIG. 1). A flow rate of fluid into and out of chambers 42, 44 may relate to a translational velocity of boom cylinders 24, while a pressure differential between chambers 42, 44 may relate to a force imparted by boom cylinders 24 on the associated structure of linkage arrangement 14.

As also illustrated in FIG. 2, boom cylinders 24 (as well as stick and tool cylinders 28, 30) may form integral portions of a hydraulic system (system) 46. System 46 may have a plurality of circuits that distribute fluid used to drive the actuators described above. In particular, system 46 may include, among other things, a first circuit 48, a second circuit 50, a third circuit 52, and a fourth circuit 54. First circuit 48 may be primarily associated with boom cylinders 24. Second circuit 50 may be primarily associated with another actuator, for example with a motor 53 that drives fan 34. Alternatively, second circuit 50 could be associated with one or more of stick or tool cylinders 28 or 30, an air conditioning motor (not shown), a brake actuator (not shown), a ride control feature (not shown), or another linear or rotary actuator (not shown) of machine 10, if desired. In some embodiments, accumulator 92 can function as an accumulator for brake or ride control features. Third circuit 52 may be primarily associated with pilot control of one or more of the other circuits (e.g., of first circuit 48). Fourth circuit 54 may be primarily associated with energy recovery and fluid sharing between the other circuits. The interaction of circuits 48-52 will be described in more detail below. It is contemplated that additional and/or different configurations of circuits may be included within system 46, if desired.

In the disclosed embodiment, each of circuits 48 and 50 may be similar and include a plurality of interconnecting and cooperating fluid components that facilitate the use and control of the associated actuators. For example, each of circuits 48 and 50 may be connected to a common pump 58 via a supply passage 60, and to a common low-pressure reservoir 62 via a drain passage 64. In addition, each of circuits 48 and 50 may include left- and right-side passages 66 and 68 for each actuator. In circuits having linear actuators (e.g., cylinders 24, 28, 30), left- and right-side passages 66, 68 may be commonly known as rod-end and head-end passages, respectively. A control valve (e.g., a boom control valve 70, a stick control valve—not shown, a tool control valve—not shown, a fan control valve 72, an air conditioning control valve, etc.) may be situated between passages 60, 64 and passages 66, 68 within each circuit 48, 50 to regulate the filling and draining of the corresponding actuators.

Selectively pressurizing passages 66, 68 may cause desired actuator movements. For example, to retract a linear actuator (e.g., to retract cylinders 24, 28, or 30), left actuator passage 66 of a particular circuit may be filled with fluid pressurized by pump 58, while the corresponding right actuator passage 68 may be filled with fluid discharged from the linear actuator. In contrast, to extend the linear actuator, right actuator passage 68 may be filled with fluid pressurized by pump 58, while left actuator passage 66 may be filled with fluid discharged from the linear actuator. To cause a rotary actuator (e.g., motor 5) to rotate in a first direction, left actuator passage 66 of circuit 50 may be filled with fluid pressurized by pump 58, while the corresponding right actuator passage 68 may be filled with fluid exiting motor 53. To reverse direction of the rotary actuator, right actuator passage 6$ may be filled with fluid pressurized by pump 58, while left actuator passage 66 may be filled with fluid exiting the actuator. The control valves associated with each actuator may be selectively moved to connect supply passage 60 with one of the left- and right-side passages 66, 68, while simultaneously connecting drain passage 64 with the other of the left- and right-side passages 66, 68 to thereby cause desired cylinder extensions and retractions or motor rotations.

At least one of the control valves described above may be pilot operated. In the disclosed example, boom control valve 70 is pilot operated. Specifically, boom control valve 70 (e.g., a single or different spools or other elements of boom control valve 70) may be movable between different positions based on the pressure of a pilot signal (i.e., a flow of pilot fluid) directed from circuit 52 to an end of boom control valve 70 via a passage 74. For example, when a first pilot signal is directed through passage 74 to a first end (and/or to a first spool or other element) of boom control valve 70, boom control valve 70 may open a connection between supply passage 60 and left actuator passage 66, and also open a simultaneous connection between right actuator passage 68 and drain passage 64. In contrast, when a second pilot signal is directed through passage 74 to a second end (and/or to a second spool or other element) of boom control valve 70, boom control valve 70 may open a connection between supply passage 60 and right actuator passage 68, and also open a simultaneous connection between left actuator passage 66 and drain passage 64. And when no signal is (or both the first and second signals are simultaneously) directed to boom control valve 70, no connections between passages 60, 64 and 66, 68 may be made. In some embodiments, the connections of the supply and drain passages 60, 64 may allow for the same flow rate of fluid therethrough (i.e., both passages 60, 64 may have the same amount of restriction placed on the fluid flow); but in other embodiments, the flow rates may be independently set and different. For example, a greater flow rate of fluid may at times be associated with the supply connection than with the drain connection (i.e., a greater restriction may be placed on the fluid flowing through the drain connection), such that a pressure of the fluid being discharged from the corresponding actuator may be selectively increased.

A pilot valve 76 may be disposed within third circuit 52 and used to generate the pilot signals directed to boom control valve 70. For example, pilot valve 76 may be mechanically connected to input device 36 and manually movable to any position between a supply position (shown in FIG. 2), a neutral position (middle position), and a drain position (lower position). When pilot valve 76 is moved toward the supply position, a pilot signal may be generated that is proportional to the position. For example, greater movement towards the supply position may result in a pilot signal having a greater pressure that causes a corresponding greater movement of boom control valve 70 to create the first of the connections described above. In contrast, movement away from the supply position toward the drain position may result in the pilot signal having a lower pressure that causes a corresponding lesser movement of boom control valve 70 to create the second of the connections described above. When pilot valve 76 is in the neutral position, boom control valve 70 may also be in a neutral position, at which no connections between passages 60, 64 and 66, 68 are made. Third circuit 52 may include a pilot passage 78 in fluid communication with pump 58 (e.g., via supply passage 60, as will be explained in more detail below) and pilot valve 76, and a drain passage 84 in fluid communication with low-pressure reservoir 62 and pilot valve 76.

In some embodiments, the pilot signal manually generated via valve 76 may be selectively overridden. In particular, circuit 54 may further include an override valve 86 that is selectively energized by a controller 88 to generate pilot signals directed to boom control valve 70. Override valve 86 may be disposed in parallel with pilot valve 76, and function in a similar manner as pilot valve 76 to create pilot signals of varying pressure directed to one or more ends of boom control valve 70. A resolver (e.g., a shuttle valve) 90 may be disposed between boom control valve 70 and pilot and override valves 76, 86, and function to allow only desired pilot signals (e.g., only those signals having a higher pressure) to reach boom control valve 70, it should be noted that, while override valve 86 and resolver 90 are shown as being two separate components in the disclosed example, it may be possible for the functionality of these components to be performed by a single valve, if desired.

Fourth circuit 54 may include multiple different components used to interconnect the other circuits for energy recovery purposes. These components may include, among other things, one or more accumulators 92 fluidly connected to right-side (i.e., head-end) passage 68 of first circuit 48 via a supply passage 94, fluidly connected to second circuit 50 via a first discharge passage 96, and fluidly connected to third circuit 52 via a second discharge passage 98. A supply valve 100 may be disposed within supply passage 94 and selectively energized by controller 88 to regulate fluid flow from right-side passage 68 (i.e., from head-end chamber 44 of boom cylinders 24) through supply passage 94 into accumulators 92. A discharge valve 102 may be disposed in passage 96 and selectively energized by controller 88 to regulate fluid flow from accumulators 92 through first discharge passage 96 to second circuit 50, and a bypass valve (e.g., a check valve) 103 may be disposed in parallel with discharge valve 102 and configured to selectively allow reverse flow from second circuit 50 back into fourth circuit 54 based on a pressure differential between the circuits. A pressure balancing valve 104 may be disposed within passage 98 to selectively allow fluid from accumulators 92 or from pump 58 to flow into third circuit 54 any time a pressure of third circuit 52 is less than a threshold amount. A lockout valve 105 may be disposed at a junction of passages 78 and 98, and manually movable to inhibit fluid flow into third circuit 52 at desired times (e.g., when the operator is not present within, machine 10). A pressure relief valve 106 may also be associated with accumulators 92, and configured to open and direct fluid from accumulators 92 to reservoir 62 when a pressure of the fluid inside accumulators 92 exceeds a maximum allowable pressure. A check valve 108 may be located downstream of pressure relief valve 106 to facilitate unidirectional fluid flow from accumulators 92 to the other circuits. In some embodiments, the size of accumulators 92 may correspond with the size of hydraulic actuator 24. For example, the volume of accumulator 92 may be about equal to the volume that piston assembly 40 consumes inside tube 38.

An additional valve arrangement may be used in some embodiments, if desired, to help regulate the use of accumulated fluid within second circuit 50. In particular, there may be times when a pressure of the accumulated fluid is less than a pressure of fluid discharged by pump 58, but still high enough for use in second circuit 50. For this reason, a control valve 110 may be disposed between passages 60 and 96, and configured to selectively inhibit high-pressure fluid from pump 58 being directed to second circuit 50 so that the lower-pressure accumulated fluid from third circuit 52 may instead by used to power motor 53 (or by other associated actuators). A check valve 112 may be disposed downstream of control valve 110 to ensure a unidirectional flow of fluid through passage 60, even when a pressure of the accumulated fluid from passage 96 is higher than fluid pressurized by pump 58 within passage 60.

Controller 88 may embody a single microprocessor or multiple microprocessors that include a means for monitoring operator input, and responsively adjusting flow directions and/or pressures within circuits 48-52. For example, controller 88 may include a memory, a secondary storage device, a clock, and a processor, such as a central processing unit or any other means for accomplishing a task consistent with the present disclosure. Numerous commercially available microprocessors can be configured to perform the functions of controller 88. It should be appreciated that controller 88 could readily embody a general machine controller capable of controlling numerous other machine functions. Various other known circuits may be associated with controller 88, including signal-conditioning circuitry, communication circuitry, and other appropriate circuitry. Controller 88 may be further communicatively coupled with an external computer system, instead of or in addition to including a computer system, as desired.

In some embodiments, controller 88 may rely on sensory information when regulating the flow directions and/or pressures within circuits 48-50. For example, instead of or in addition to the signals generated by input device 36, controller 88 may communicate with one or more sensors 114 to detect an actual pressure (e.g., a pressure of accumulators 92). Controller 88 may then automatically adjust flow directions and/or pressures based on the signals generated by sensor(s) 114.

INDUSTRIAL APPLICABILITY

The disclosed hydraulic system may be applicable to any machine that performs a substantially repetitive work cycle, which involves raising and lowering movements of a work tool. The disclosed hydraulic system may improve machine performance and efficiency by assisting movements of the work tool with accumulators during different segments of the work cycle. In addition, the disclosed hydraulic system may improve machine efficiency by capturing and reusing otherwise wasted energy in a number of different ways. Control of hydraulic system 46 will now be described in detail with reference to FIG. 2.

During operation of machine 10, power source 15 (referring to FIG. 1) may drive pump 58 to draw fluid from reservoir 62 and pressurize the fluid. The pressurized fluid may be directed, for example, through passage 60 of second circuit 50 to fan control valve 72. Fan control valve 72 may be automatically actuated (e.g., hydraulically or electrically) by controller 88 to drive fan motor 53 at a speed and/or in a direction corresponding to a cooling demand of power source 15 and/or other components and systems of machine 10. In particular, fan control valve 72 may be moved to establish a desired connection between passage 60 and one of passages 66, 68, and also a desired connection between passage 64 and the other of passages 66, 68. The passage 66, 68 chosen for the connection with passage 60 or passage 64 may determine a rotation direction, while a restriction placed on the connections by fan control valve 72 may establish a torque and/or a speed of the rotation. It is contemplated that fan control valve 72 may be activated in response to an operation of power source 15 (e.g., a load, a speed, a duration, etc.), a temperature of power source 15 (or other components of machine 10), or any other condition known in the art.

In addition to directing pressurized fluid through fan motor 53, the fluid pressurized by pump 58 may also simultaneously be directed through passage 60 of first circuit 48 to boom control valve 70. The operator of machine 10 may then have manual control over the movement of boom control valve 70 to create a desired fluid connection and corresponding movement of boom cylinders 24. For example, the operator may be able to move input device 36 in a desired direction by a desired amount to selectively direct a pilot signal of a desired pressure to boom control valve 70. In response to being exposed to the pilot signal, boom control valve 70 may move to connect passage 60 with one of passages 66 or 68, and simultaneously connect the other of passages 66 or 68 with passage 64. When passage 60 is connected with passage 68 and passage 64 is simultaneously connected with passage 66, cylinders 24 may be caused to extend through a positive pressure differential created across piston assembly 40. In contrast, when passage 60 is connected with passage 66 and passage 64 is simultaneously connected with passage 68, cylinders 24 may be caused to retract through a negative pressure differential created across piston assembly 40.

As described in the previous section, boom control valve 70 may be a pilot operated valve. Specifically, the fluid pressurized by pump 58 may be directed through passage 60, passage 96, and passage 78 to pilot valve 76. When the operator moves input device 36, an amount of this fluid may be passed as the pilot signal to boom control valve 70, thereby affecting the desired movement of boom control valve 70.

In some situations, during the retracting motion of cylinders 24, when boom 20 (referring to FIG. 1) is heavily loaded, the fluid being discharged from head-end chambers 44 of boom cylinders 24 may have an elevated pressure. In these situations, directing the high-pressure fluid back to reservoir 62 could be inefficient. Accordingly, the fluid being discharged from boom cylinders 24 may be selectively accumulated. Specifically, controller 88 may command supply valve 100 to open and allow the discharging fluid to enter accumulators 92. In some instances, this command may only be issued based on a pressures signal from sensor 114 (e.g., a signal indicating a low pressure within accumulators 92).

The fluid collected within accumulators 92 may be used to supplement and/or replace the fluid pressurized by pump 58, thereby conserving energy normally used to pressurize the fluid. For example, the pressurized fluid may be used within third circuit 52 as pilot fluid in place of fluid supplied by pump 58. Specifically, the fluid from accumulators 92 may be directed through check valve 108, passage 98, valve 104 (assuming pilot fluid is needed within circuit 52), valve 105 (assuming circuit 52 is not locked out by the operator), and passage 78 to pilot valve 76.

In addition, or alternatively, the fluid from accumulators 92 may be directed through check valve 108, passage 96, control valve 102, and passage 60 to fan control valve 72 (or to the control valve of another associated actuator, such as an air conditioning actuator, stick cylinder 28, or tool cylinder 30). In this situation, controller $8 may close valve 110 to ensure that the accumulated fluid is being used to drive fan motor 53 and fluid from pump 58 is not being used.

In some applications, there may not be enough accumulated fluid to supply both of second and third circuits 50, 52.

And if the fluid being supplied to third circuit 52 was suddenly completely consumed, input device 36 could be left without enough pilot fluid to adequately control movement of boom control valve 70. Similarly, in cases when power source 15 is shut off with boom 20 raised, it may be desirable for the operator to have sufficient pilot fluid to lower boom 20 without the aid of power source 15. For this reason, controller 88 may be configured to selectively prioritize fluid supply of third circuit 52 over second circuit 50. In particular, as the fluid within accumulators 92 begins to run out, controller 88 may selectively close valve 102 to inhibit further consumption of accumulated fluid by second circuit 50. For example, as a pressure within accumulators 92 falls below a low-threshold limit (e.g., about 5 mPa), as sensed via sensor 114, controller 88 may generate a command causing valve 102 to close and block flow into passage 60 from accumulators 92.

It may be desirable to selectively affect a pressure of the fluid being discharged from boom cylinders 24. In particular, although boom 20 may be lowering under the effects of gravity, the fluid being discharged from boom cylinders 24 may not be high enough for some operations. In this situation, controller 88 may be configured to selectively increase the pressure by placing a restriction on the flow of fluid passing through boom control valve 70 to low-pressure reservoir 62. Specifically, controller 88 may generate a command directed to override valve 86, causing override valve 86 to create a pilot signal that moves boom control valve 70 to a more restrictive position (i.e., to a position that closes off the connection between right-side passage 68 and drain passage 64). When this happens, the pressure of the fluid being discharged from head-end chambers 44 of boom cylinders 24 may increase.

In some situations, the operator may want to manually control the restriction placed on the fluid flow exiting head-end chambers 44 of boom cylinders 24. In particular, by restricting the discharge flow rate of boom cylinders 24, boom cylinders 24 may retract at a slower rate, causing boom 20 (referring to FIG. 1) to also lower at a slower rate. In some situations, the operator may desire boom 20 to lower faster and, accordingly, displace input device 36 to a greater degree. When this happens, pilot valve 76 may create a pilot signal greater than the signal created by override valve 86. In other words, the flow of pilot fluid passing through pilot valve 76 may have a pressure that is greater than a pressure of the fluid passing through override valve 86. When this happens, resolver 90 may move to block the signal generated by override valve 86 and pass only the signal from pilot valve 76 to boom control valve 70. In this way, the operator may selectively override the override valve 86 to speed up the downward movement of boom 20.

Several benefits may be associated with the disclosed hydraulic system. For example, because the disclosed hydraulic system may integrate multiple actuator circuits during energy recovery and reuse, a greater amount of energy may be stored and re-used. Further, because the disclosed system may provide priority to a pilot circuit, operator control may be ensured even during times of low fluid supply.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system, comprising:

a pump configured to pressurize fluid;

a first actuator configured to receive pressurized fluid from the pump;

an accumulator configured to receive fluid from the first actuator;

a second actuator configured to receive pressurized fluid from the pump and the accumulator;

a pilot circuit configured to receive pressurized fluid from the pump and the accumulator;

at least one valve movable to provide priority of fluid flow from the accumulator to the pilot circuit over the second actuator when a pressure of the accumulator is less than a low-pressure threshold; and a pressure control valve configured to selectively allow pressurized fluid from the accumulator into the pilot circuit only when a pressure of the pressurized fluid in the accumulator is greater than a pressure of fluid being discharged by the pump.

2. The hydraulic system of claim 1, wherein the at least one valve is configured to selectively block fluid flow from the accumulator to the second actuator.

3. The hydraulic system of claim 2, further including:

a pressure sensor configured to generate a signal indicative of a pressure of fluid in the accumulator; and a controller in communication with the pressure sensor and the at least one valve, the controller being configured to command movement of the at least one valve to a flow-blocking position based on the signal.

4. The hydraulic system of claim 1, wherein:

the first actuator is a boom cylinder; and the second actuator is a fan motor.

5. The hydraulic system of claim 4, further including:

a boom control valve movable to regulate fluid flow from the pump to the boom cylinder;

an operator input device movable to indicate a desired movement of the boom cylinder; and a pilot valve connected to the operator input device and configured to selectively direct pilot fluid from the pilot circuit to move the boom control valve.

6. The hydraulic system of claim 5, further including a pressure control valve configured to direct pilot fluid from the pilot circuit to the boom control valve.

7. The hydraulic system of claim 6, further including a shuttle valve disposed between the boom control valve and the pilot and pressure control valves, the shuttle valve configured to pass only a higher-pressure flow from one of the pilot and pressure control valves to the boom control valve.

8. The hydraulic system of claim 6, further including:

a low-pressure reservoir configured to receive fluid from the boom cylinder and the fan motor; and a controller in communication with the pressure control valve, the controller being configured to command movement of the pressure control valve that causes the boom control valve to vary a restriction placed on fluid being discharged from the boom cylinder to the low-pressure reservoir, wherein the restriction is proportional to a pressure of fluid being received by the accumulator.

9. The hydraulic system of claim 6, further including a fan control valve disposed between the pump and the fan motor.

10. The hydraulic system of claim 9, further including a directional control valve disposed downstream of the at least one valve and the fan control valve.

11. The hydraulic system of claim 1, further including an accumulator control valve disposed between the first actuator and the accumulator.

12. The hydraulic system of claim 1, wherein:

the at least one valve is a first valve; and the hydraulic system further includes:

a third actuator configured to receive pressurized fluid from the accumulator and from the pump.

13. The hydraulic system of claim 1, wherein:

the accumulator is a first accumulator; and the hydraulic system further includes a second accumulator configured to receive fluid from the first actuator in parallel with the first accumulator.

14. A machine, comprising:

a frame;

a boom pivotally connected to the frame;

a boom cylinder configured to move the boom;

an engine supported by the frame;

a fan configured to cool the engine;

a fan motor configured to drive the fan;

a pump driven by the engine to pressurize fluid directed to the boom cylinder and to the fan motor;

a boom control valve disposed between the pump and the boom cylinder, the boom control valve movable to affect fluid flow from the pump into the boom cylinder;

an operator input device movable to indicate a desire to raise or lower the boom;

a pilot valve connected to the operator input device and movable to affect a flow of pilot fluid to the boom control valve;

a pressure control valve movable to affect a flow of pilot fluid to the boom control valve;

a shuttle valve disposed between the boom control valve and the pilot and pressure control valves;

an accumulator configured to receive fluid discharged from the boom cylinder, and to discharge fluid to the fan motor and to the pilot and pressure control valves; and a priority valve configured to selectively block fluid flow from the accumulator to the fan motor when a pressure of the accumulator is less than a low-pressure threshold.

15. The machine of claim 14, further comprising:

a pilot circuit configured to receive pressurized fluid from the pump and the accumulator;

a pressure control valve configured to selectively allow pressurized fluid from the accumulator into the pilot circuit only when a pressure of the pressurized fluid in the accumulator is greater than a pressure of fluid being discharged by the pump.

16. The machine of claim 14, further comprising:

a pilot circuit configured to receive pressurized fluid from the pump and the accumulator;

a pressure control valve configured to direct pilot fluid from the pilot circuit to the boom control valve; and a low-pressure reservoir configured to receive fluid from the boom cylinder and the fan motor.

17. The machine of claim 16, further comprising:

a controller in communication with the pressure control valve, the controller being configured to command movement of the pressure control valve that causes the boom control valve to vary a restriction placed on fluid being discharged from the boom cylinder to the low-pressure reservoir, wherein the restriction is proportional to a pressure of fluid being received by the accumulator.

18. A method of recovering energy, the method comprising:

pressurizing fluid at a first location;

directing pressurized fluid from the first location through a control valve to a first actuator and to a second actuator, the first actuator being a boom cylinder;

accumulating fluid discharged from the first actuator;

directing the accumulated fluid to the second actuator and to a pilot circuit associated with the first actuator;

selectively inhibiting the accumulated fluid from flowing to the second actuator based on a pressure of the accumulated fluid; and selectively restricting fluid discharge from the boom cylinder to a low-pressure reservoir to increase a pressure of the accumulated fluid, selectively restricting the fluid discharge including selectively overriding a pilot signal directed to a control valve associated with the boom cylinder.

19. The method of claim 18, further including sensing the pressure of the accumulated fluid, wherein selectively inhibiting includes selectively inhibiting accumulated fluid from flowing to the second actuator when a pressure of the accumulated fluid falls below a low-pressure threshold.

20. The method of claim 18, wherein:

the second actuator is a fan motor; and accumulating fluid includes accumulating fluid from a head end of the boom cylinder during a retraction operation.

* * * * *